US006125867A

United States Patent [19]

Ishizaka

[11] Patent Number: 6,125,867

[45] Date of Patent: Oct. 3, 2000

[54] SELF-SUPPORTING UMBRELLA

[75] Inventor: Takeshi Ishizaka, No. 27-12, 3-chome, Midoridai, Kashiwa-shi, Chiba-ken, Japan

[73] Assignee: Takeshi Ishizaka, Chiba-ken, Japan

[21] Appl. No.: 09/039,384

[22] Filed: Mar. 16, 1998

[51] Int. Cl.[7] ..... A45B 9/04

[52] U.S. Cl. ..... 135/16; 135/19; 135/22; 135/84; 135/77; 248/169; 248/171

[58] Field of Search ..... 135/16, 22, 19, 135/17, 24, 44, 66, 77, 84, 80; 248/155, 155.1, 155.2, 170, 169, 171

[56] References Cited

U.S. PATENT DOCUMENTS

| | | | |
|---|---|---|---|
| 1,089,295 | 3/1914 | Vallier | 248/155 X |
| 2,753,879 | 7/1956 | Rosen . | |
| 3,091,249 | 5/1963 | O'Neil | 135/16 |
| 4,062,372 | 12/1977 | Slusher | 135/66 |
| 4,091,828 | 5/1978 | Jorgensen | 135/66 |
| 5,755,245 | 5/1998 | Van Helvoort | 135/66 X |
| 5,823,491 | 10/1998 | Lindsay et al. | 248/169 |

FOREIGN PATENT DOCUMENTS

| | | | |
|---|---|---|---|
| 0 015 034 | 9/1980 | European Pat. Off. . | |
| 1507082 | 12/1967 | France | 248/169 |
| 117 616 | 2/1901 | Germany . | |
| 538 487 | 11/1931 | Germany . | |
| 42 05 873 | 7/1992 | Germany . | |
| 63-138121 | 9/1988 | Japan . | |
| 3-31312 | 3/1991 | Japan . | |
| 1109670 | 4/1968 | United Kingdom . | |

*Primary Examiner*—Carl D. Friedman
*Assistant Examiner*—Winnie Yip
*Attorney, Agent, or Firm*—Arent Fox Kintner Plotkin & Kahn, PLLC

[57] ABSTRACT

A self-supporting umbrella has a handle at a base end portion of a front shank and a ferrule at a front end portion of said shank. The ferrule includes a plurality of legs which are capable of being opened and closed. A projection which extends inward is formed inside a base end of each of the leg portions so as to pivotally mount the base end of each of the legs on a ferrule base portion. A resilient member is fitted into a front end portion of the shank such that a leg operating member having a restricted section in an axially intermediate portion thereof can be disposed on a front end of the resilient member. The restricted section is adapted to pinch therein the projection. The leg operating member is urged by a resilient force of the resilient member toward the front end of the umbrella. An adjusting device is provided in the handle, and a connecting member is provided to connect the adjusting device and the leg operating member together such that the legs are opened and closed by moving the leg operating member by the adjusting device via the connecting member.

3 Claims, 7 Drawing Sheets

SELF-SUPPORTING UMBRELLA

BACKGROUND OF THE INVENTION

1. Field of the Invention

The present invention relates to a self-supporting umbrella which can be held in a self-standing state even in a place where an umbrella stand is not available, such as on a platform of a railway station, inside a train, or the like.

2. Description of the Related Art

As this kind of self-supporting umbrella, there has hitherto been known one in Japanese Published Unexamined Utility Model Registration Application No. 31312/1991. Namely, as shown in FIGS. 10A and 10B, this self-supporting umbrella has a ferrule D which is made up of a ferrule base portion B having a cylinder portion A, and a leg mechanism C which is disposed at a front end of the ferrule base portion B and which is capable of being opened and closed. The cylinder portion A is provided with an engaging hook E and is also provided therein with a leg operating member G which is movable up and down so as to open and close the leg mechanism C. The leg operating member G has a rod H which is connected to links Cb. The links Cb of the leg mechanism C are operated by the up and down movement of this rod H, whereby legs Ca are opened and closed.

Normally, as shown in FIG. 10A, the leg operating member G is pushed down by a resilient force of the spring F inside the cylinder portion A to thereby push down the links Cb. The leg mechanism C is thus maintained in a state in which the legs are closed. When the rod H, i.e., the leg operating member G is pushed up by urging the lower end of the rod H against the ground, the spring F is compressed as shown in FIG. 10B, and the leg mechanism C is opened. Once the engaging hook E is engaged with a notched portion J of the leg operating member G, the legs are kept opened.

In order to return the legs to the closed state, the engaging hook E is pushed by hand to thereby release the engagement between the engaging hook E and the leg operating member G. Then, due to the resilient force of the spring F, the leg operating member G returns to the original position, whereby the leg mechanism C returns to the closed state.

This self-supporting umbrella has, however, the following disadvantage. Namely, the spring F and the leg operating member G are disposed inside the cylinder portion A. Further, since the leg mechanism C which is capable of opening and closing is provided with links Cb which are connected to the rod H, the construction is complicated. In addition, since both ends of the links Cb are made in a pin-connection construction, the assembly of the umbrella is troublesome.

Still furthermore, this self supporting umbrella has the following disadvantage. Namely, when the leg mechanism C is operated to open the legs, the engaging hook E must successfully be brought into engagement with the notched portion J of the leg operating member G. In other words, the failure in engagement will end in a failure in maintaining the legs opened, with the result that the operation of opening the legs is not always easy. In addition, in order to close the legs, the engaging hook E must be pushed by hand. Since the ferrule D is likely to be stained, this operation results in the stain in fingers of the operator or the bearer. This conventional self-supporting umbrella has still another disadvantage in that the operation of the leg mechanism is limited to either fully opening the legs or fully closing them and therefore that the opening degree of the legs cannot be adjusted.

The present invention has an object of providing a self-supporting umbrella in which the assembling can be made easily, in which the opening and closing of the legs can be made without staining the hands of the operator or the bearer, and in which the opening degree of the legs can be adjusted.

SUMMARY OF THE INVENTION

In order to attain the above and other objects, the present invention is a self-supporting umbrella comprising a handle at a base end portion of a shank and a ferrule at a front end portion of said shank, the ferrule comprising a plurality of legs which are capable of being opened and closed, characterized in: that a projection which extends inward is formed inside a base end of each of the legs so as to pivotally mount the base end of each of the legs on a ferrule base portion; that a resilient member is fitted into a front end portion of the shank such that a leg operating member having a diametrically restricted section in an axially intermediate portion thereof can be disposed on a front end of the resilient member, the restricted section being adapted to pinch therein the projection, the leg operating member being urged by a resilient force of the resilient member toward the front end of the umbrella; that an adjusting device is provided in said handle; and that a connecting member is provided to connect the adjusting device and the leg operating member together such that the legs are opened and closed by moving the leg operating member by the adjusting device via the connecting member.

When the adjusting device is operated in the direction to open the legs, the leg operating member moves toward the front end of the umbrella by the resilient force of the resilient member which is fitted into the front end portion of the shank. As a result of the movement of the leg operating member toward the front end, that inward projection of each of the legs which is pinched by the restricted portion in the axially intermediate portion of the leg operating member is rotated or swung, together with the legs, with the pivoting portion functioning as a center of rotation, whereby the legs to constitute the ferrule are opened.

When the adjusting member is operated in the direction to close the legs, the leg operating member which is coupled together by the adjusting device and the connecting member, moves toward the handle by the resilient force of the resilient member. As a result, that inward projection of each of the legs which is pinched by the restricted portion in the axially intermediate portion thereof is rotated or swung, together with the legs, in the direction opposite to that at the time of opening the legs, whereby the legs are closed.

It is preferable to arrange such that the adjusting device comprises: a pin which is movable inside a slit longitudinally formed on that side of the shank which lies near the handle, the pin being tightly connected via the connecting member to the leg operating member; a female-threaded adjusting cylinder which has an end surface looking toward the handle; wherein both ends of the pin extend beyond the slit for engaging with the end surface of the adjusting cylinder and wherein the female-threaded adjusting cylinder is engaged with a cylindrical bolt portion which is provided in that end potion of the handle which lies near the shank such that the legs are opened and closed by moving the pin by the operation of the female-threaded adjusting cylinder.

When the female-threaded adjusting cylinder is rotated to open the legs, since the female thread of the adjusting cylinder is engaged with the cylindrical bolt at the end of the shank, the female-threaded adjusting cylinder moves in the direction to open the legs, i.e., toward the front end of the umbrella. As a result of the movement of the leg operating member toward the front end of the umbrella due to the resilient force of the resilient member, that projection on the inside of the base end portion of each of the legs which is pinched by the restricted portion in the axially intermediate of the leg operating member is rotated together with the legs, whereby the legs to constitute the ferrule are opened.

When the female-threaded adjusting cylinder is rotated in the opposite direction to close the legs, since the female thread of the adjusting cylinder is engaged with the cylindrical bolt, the female-threaded adjusting cylinder moves in the direction of closing the legs, i.e., toward the handle. As a result, the leg operating member which is tightened or extended by the pin and the connecting wire also moves toward the handle against the resilient force of the resilient member. As a result, that projection on the inside of the base end portion of each of the legs which is pinched by the restricted portion in the axially intermediate of the leg operating member is rotated together with the legs in the direction opposite to that at the time of opening the legs, whereby the legs formed in the ferrule are closed.

It is also preferable to arrange that the female-threaded adjusting cylinder is movable in an axial direction of the shank relative to the cylindrical bolt portion such that a female thread of the female-threaded adjusting cylinder comes into engagement with the threaded portion of the cylindrical bolt portion near an end of a stroke of closing the legs.

The female-threaded adjusting cylinder is pulled toward the handle to thereby close the legs in the ferrule. Near the end of the stroke for closing the legs, the female thread of the female-threaded adjusting cylinder comes into engagement with the threaded portion of the cylindrical bolt portion. The legs are thus maintained in the closed state. When the legs are opened, the female-threaded adjusting cylinder is slightly rotated. Then, the engagement between the female-threaded adjusting cylinder and the threaded portion of the cylindrical bolt portion is released. As a result, due to the resilient force of the resilient member, the leg operating member moves toward the front end of the umbrella. The legs to constitute the ferrule are thereby opened.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
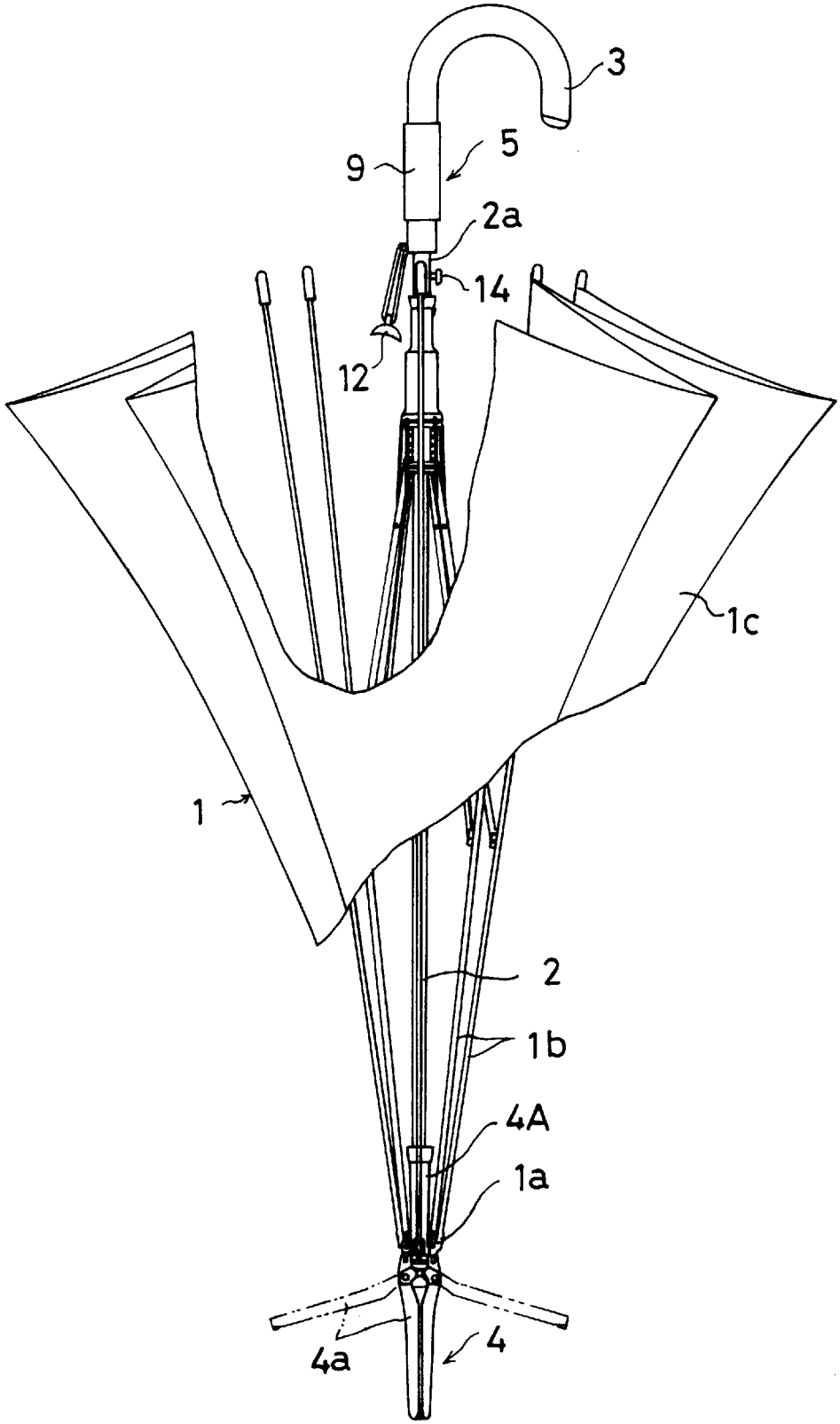
FIG. 1 is an overall view of a self-supporting umbrella of the present invention, partly cut to show the details of important portions thereof.

In FIG. 1, the reference numeral 1 denotes a self-supporting umbrella, reference numeral 2 denotes a shank, reference numeral 3 denotes a handle which is attached to a base end portion 2*a* of the shank 2 (the term "base end" refers to a portion as compared with a front end of the umbrella itself), reference numeral 4 denotes a ferrule which has as its constituting elements leg portions 4*a* to be operated for opening and closing by an adjusting device 5 (hereinafter simply called legs 4*a*). At a base portion 4A of the ferrule 4 (hereinafter called "a ferrule base portion 4A"), there is provided an upper ring 1*a* (the term "upper" refers to an upper position when the umbrella is in use). A plurality of spreaders 1*b*, 1*b* are attached to the upper ring 1*a* so that they can be opened and closed, and the spreaders 1*b*, 1*b* are spread (or covered) with a canopy 1*c*.

Figure 2:
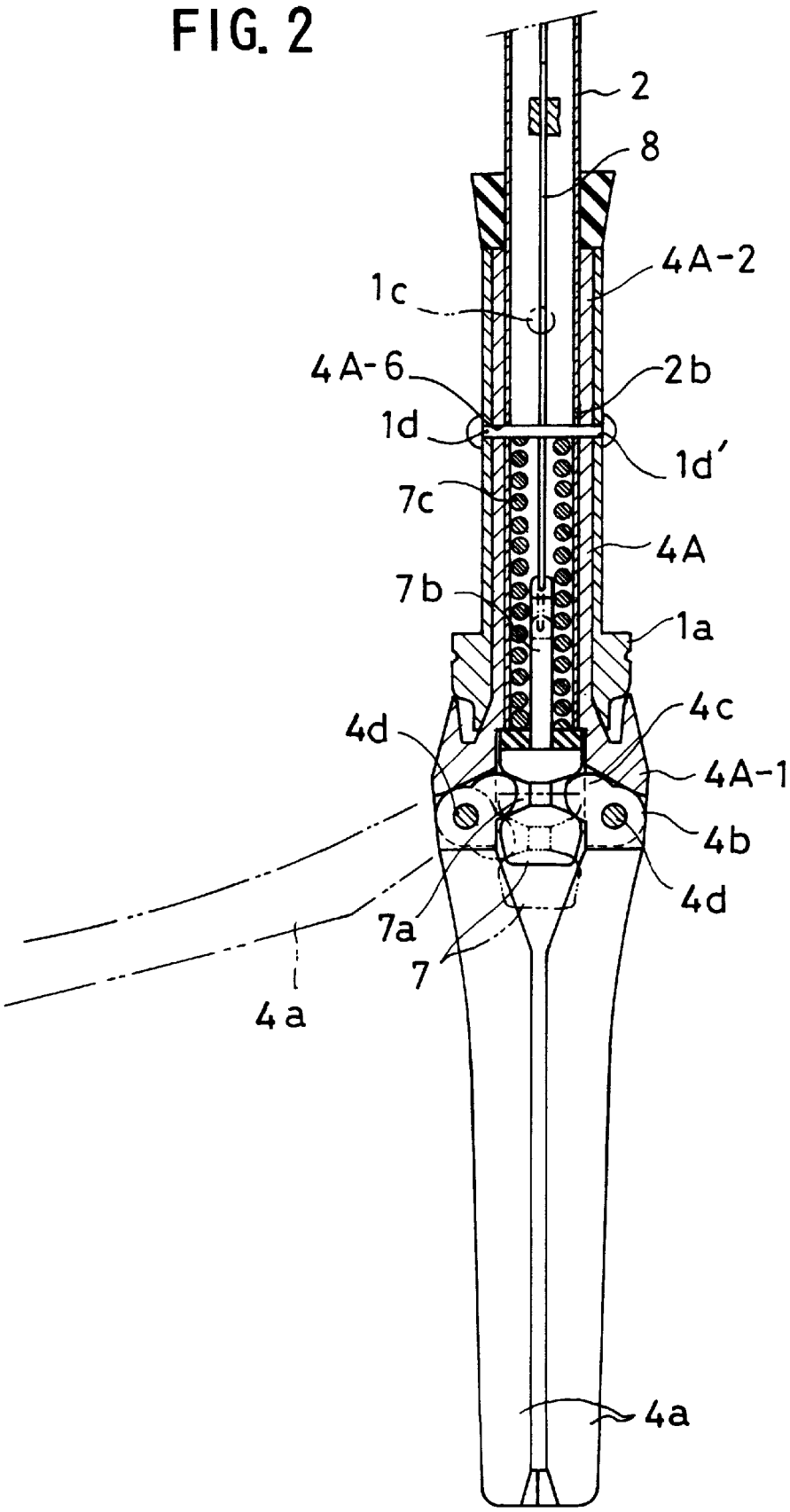
FIG. 2 is an enlarged view of a ferrule of the self-supporting umbrella.

As shown in FIG. 2, the ferrule base portion 4A is mounted on a front end of the shank 1*b* (the "front" of the shank 2 is defined to be the side opposite to the handle 3). The legs 4*a* which can be opened and closed are pivotally mounted on the ferrule base portion 4A.

Figure 3A:
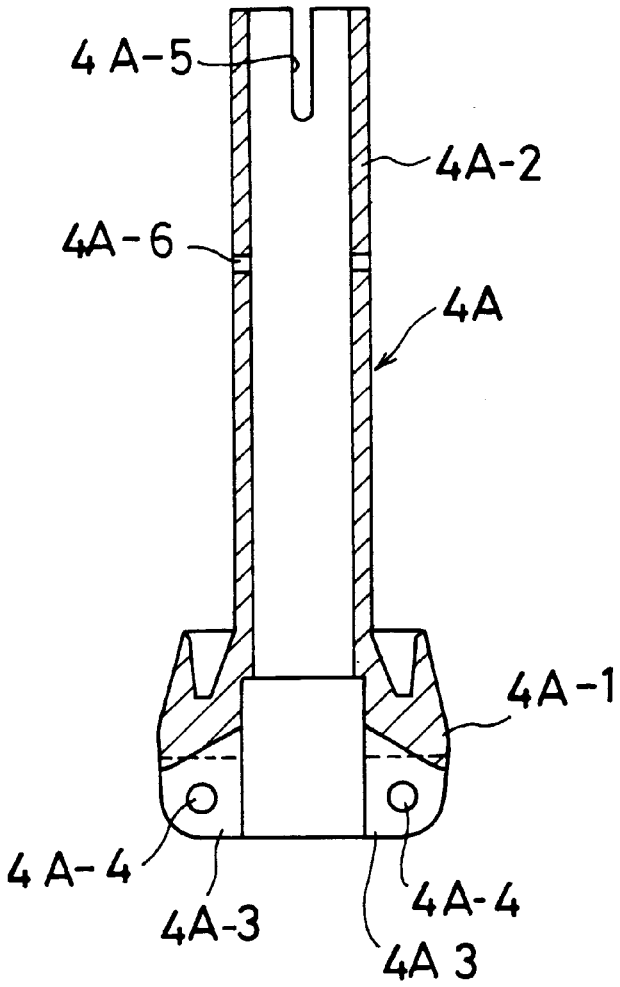
FIG. 3A is a sectional view of a ferrule base portion.

As shown in FIG. 3A, the ferrule base portion 4A is made up of a base portion main body 4A-1 and a tubular mounting portion 4A-2. The legs 4*a* illustrated in FIG. 2 are pivotally mounted on the base portion main body 4A-1, and the front end portion 2*b* of the shank 2 is inserted into the tubular mounting portion 4A-2.

Before inserting the base portion main body 4A-1 onto the shank 2, the above-described upper ring 1*a* is fitted into the front end portion 2*b* of the shank 2. As shown in FIG. 2, the upper ring 1*a* and the front end portion 2*b* of the shank 2 are fixed together by means of a nail 1*c*. As shown in FIGS. 2 and 3A, the mounting portion 4A-2 of the ferrule base portion 4A is inserted into the space between the front end 2*b* of the shank 2 and the upper ring 1*a*. The nail 1*c* is then inserted into a slit 4A-5 at a base end of the mounting portion 4A-2.

Then, as shown in FIGS. 2 and 3A, a nail 1*d* is inserted from a hole 1*d*' of the upper ring 1*a* through a hole 4A-6 in the mounting portion 4A-2 of the ferrule base portion 4A. The upper ring 1*a*, the mounting portion 4A-2 and the front end portion 2*b* of the shank 2 are thus fixed together.

Alternatively, the following arrangement may also be employed. Namely, in inserting the front end portion 2*b* of the shank 2 into the mounting portion 4A-2 to thereby mount the upper ring 1*a* on the mounting portion 4A-2, as described above, a cylindrical jig having a alit is employed. A nail is inserted into the slit to thereby nail down the front end portion 2*b* of the shank 2 and the upper ring 1*a*. Thereafter, the jig is pulled out of position, and the upper ring 1*a*, the mounting portion 4A-2, and the front end portion 2*b* of the shank 2 are nailed down by another nail to thereby fix them together.

Figure 3B:
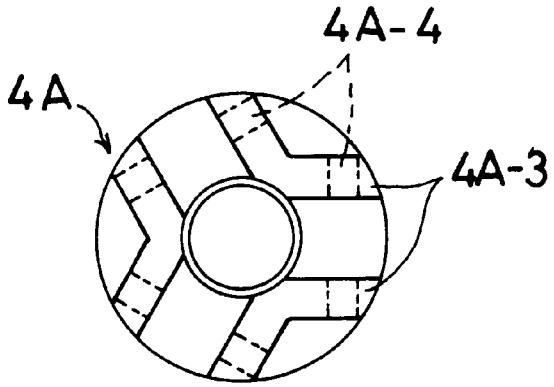
FIG. 3B is an end view of the ferrule base portion.

The illustrated self-supporting umbrella is an embodiment in which the ferrule 4 is divided into three segments at an equal distance of 120° therebetween. On that end surface of the base portion main body 4A-1 which is on the side of the ferrule, there are provided substantially V-shaped projections 4A-3 having mounting holes 4A-4 at three portions at an equal distance of 120° therebetween, as shown in FIG. 3B.

Figure 4A:
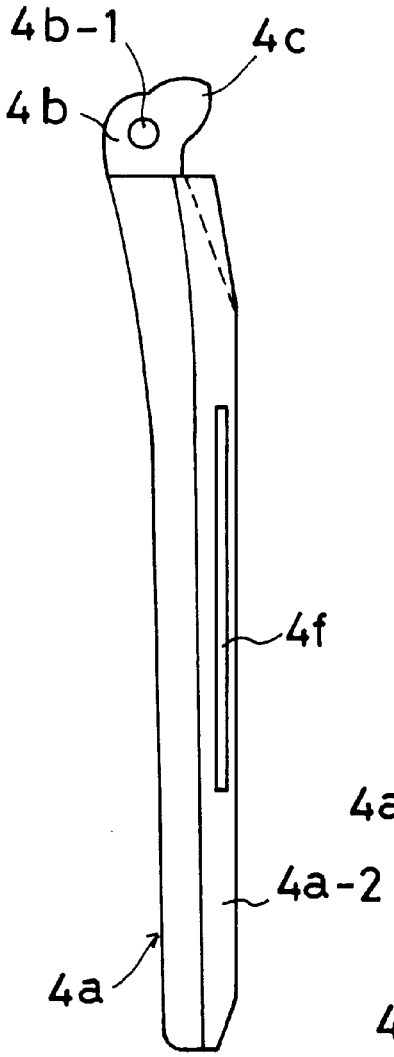
FIG. 4A is a side view of a leg portion of the ferrule.

The base end portion of each of the three legs 4*a* is provided, as shown in FIG. 4A, with a pivoting portion 4*b* which has a hole 4*b*-1. An inwardly extending projection 4*c* is provided on the inside of the pivoting portion 4*b*.

Figure 4B:
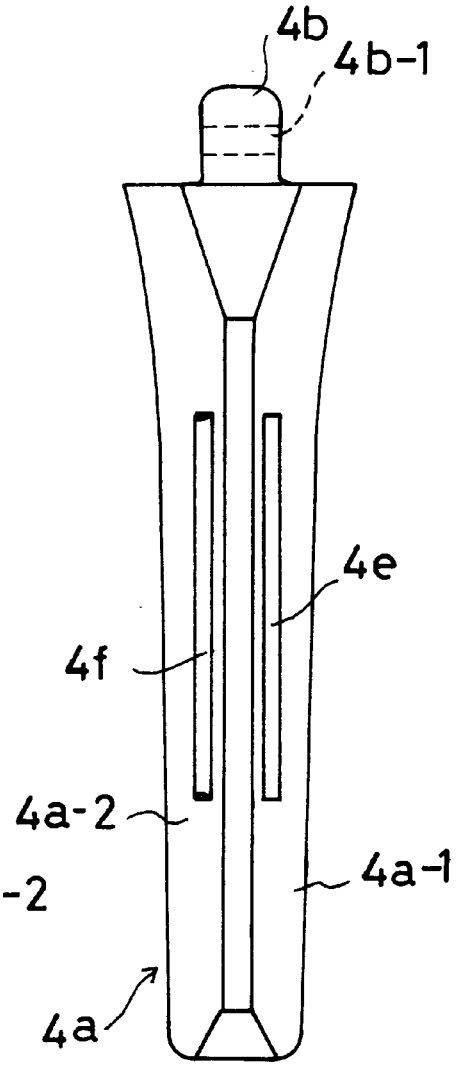
FIG. 4B is a plan view of the leg portion of the ferrule.
Figure 4C:
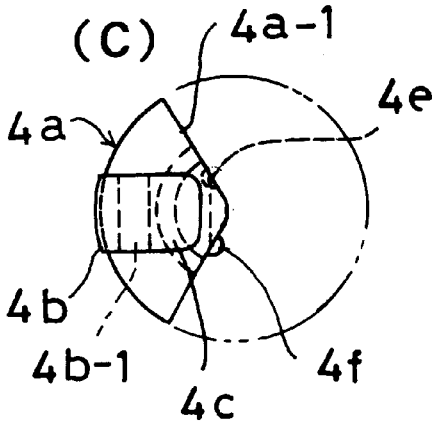
FIG. 4C is a front view of the leg portion which constitutes the ferrule.

As shown in FIGS. 4B and 4C, each of coupling (or abutting) surfaces 4*a*-1 and 4*a*-2 of respective legs 4*a* is respectively provided with dented portions 4*e* and projections 4*f* which are engaged together, when closed, to secure a firm connection (or abutment) between the two members.

The legs 4*a* may be increased in number to more than three. Then, the ferrule 4 is divided into an angle obtained by evenly dividing by the number of the legs.

Figure 5:
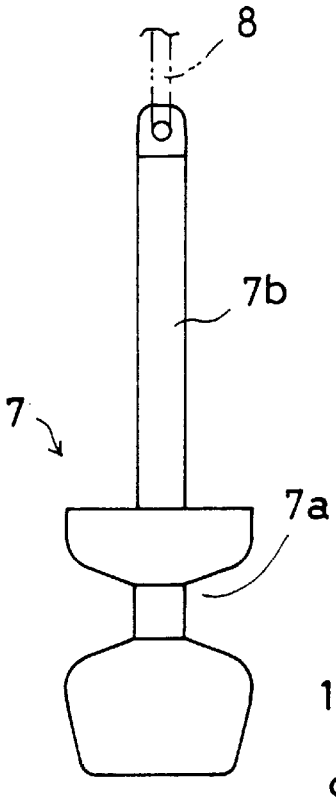
FIG. 5 is a schematic view of a leg operating member.

As shown in FIG. 5, a member 7 to operate for opening or closing the legs (hereinafter called a leg operating member 7) is formed into the shape of a pestle which is provided with a portion 7*a* which is restricted in the diametrical direction (or narrow section 7*a*). This restricted section 7*a* is positioned in an intermediate portion as seen in the axial direction. It is further provided with a rod 7*b* for mounting a connecting member 8 which is in the form of a connecting wire such as a wire or a piano wire.

As shown in FIG. 2, a resilient member 7*c* which is, for example, in the form of a coil spring is mounted inside the front end portion 2*b* of the tubular shank 2. At the front end (i.e., the lower end as seen in FIG. 2) of the resilient member 7*c* there is disposed the leg operating member 7 to which is connected the connecting member 8. It is preferable to provide the space between the leg operating member 7 and the resilient member 7*c* with a rubber washer to prevent the rain water from entering the shank 2.

Each of the legs 4*a* is made into the posture as shown by dotted lines in FIG. 2. The pivoting portion 4*b* of each of the legs 4*a* is inserted or placed into the space between projections 4A-3, 4A-3, and the projection 4*c* of each of the legs 4*a* is pinched or held in position by the restricted portion 7*a* of the leg operating member 7. A shaft 4*d* is then inserted into each of the holes 4A-4, 4*b*-1. Each of the base portion main bodies 4A-1 and each of the legs 4*a* are thus pivotally connected with each other.

When the legs 4*a* are made into the closed state as shown by solid lines in FIG. 2, the leg operating member 7 moves toward the handle 3 to thereby move the resilient member 7*c*. The movement of the resilient member 7*c* is however stopped by the nail 1*d*, whereby the resilient member 7*c* is compressed. As a result, the leg operating member 7 is urged toward the front end of the umbrella 1 by the resilient force of the resilient member 7*c*.

Figure 6:
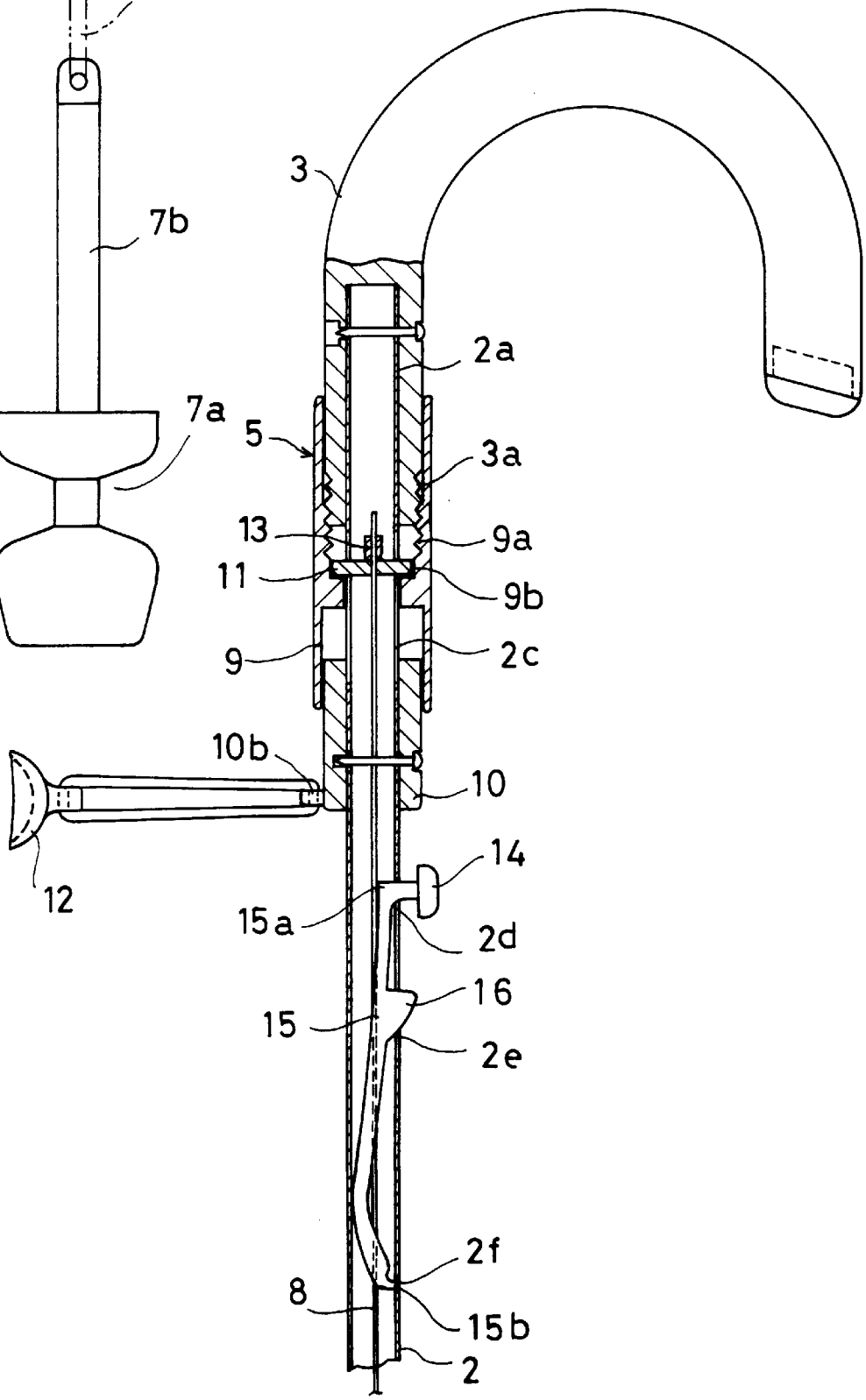
FIG. 6 is a sectional view showing the arrangement of a female-threaded adjusting cylinder in a state in which the legs in the ferrule are closed.

Then, as shown in FIG. 6, a stopper member 10 to restrict the movement of an adjusting cylinder 9 which is provided on its inner circumference with a female thread (hereinafter called "a female-threaded adjusting cylinder 9") is fixed by a nail to the base end portion 2*a* of the shank 2.

As shown in FIG. 6, inside the slit 2*c* which is provided in the longitudinal direction of that side of the shank 2 which lies on the side of the handle 3, a movable pin 11 whose both ends are projected outside the slit 2*c* is mounted as a part of the adjusting device 5.

Figure 7:
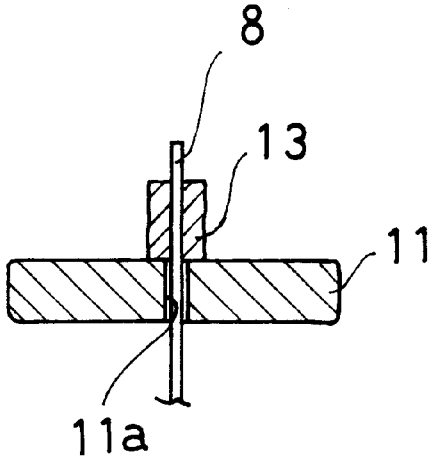
FIG. 7 is a side view of a pin.

The pin 11 is made, as shown in FIG. 7, into the shape of a short bar which is provided therein with a hole 11*a* into which the connecting member 8 is inserted.

One end of the connecting member 8 which is tied to the rod 7*b* of the leg operating member 7 is picked up through the slit 2*c* by using a tool such as a small hook or the like. Said pulled out one end of the connecting member 8 is inserted into the hole 11*a* of the pin 11. A locking member 13 which has a larger cross-sectional area than the diameter of the hole 11*a* is tied to said one end of the inserted connecting member 8 to thereby prevent the connecting member 8 from being pulled out of the hole 11*a*.

Further, as shown in FIG. 6, a cylindrical bolt portion 3*a* is provided in that end portion of the handle 3 which lies on the side of the shank 2. The handle 3 is fixed to the shank 3 with a nail such that the cylindrical bolt portion 3*a* is positioned near the slit 2*c*.

Figure 8:
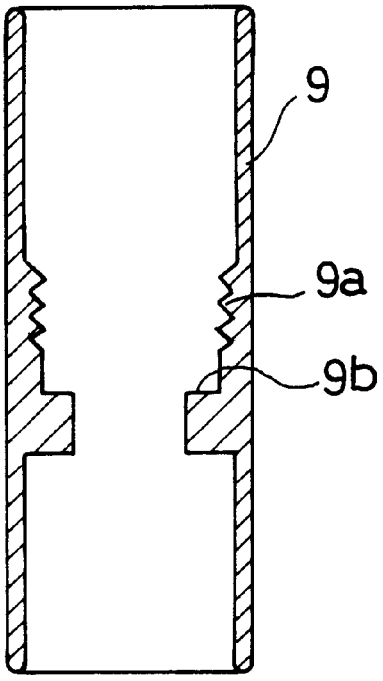
FIG. 8 is a sectional view of the female-threaded adjusting cylinder.

As a part of the adjusting device 5, the female-threaded adjusting cylinder 9 is provided, as shown in FIG. 8, with a female thread 9*a* on a central inner circumference by making hollow both ends of the cylinder 9. As shown in FIG. 6, the female thread 9*a* which is provided on the inner side of the adjusting cylinder 9 is engaged in a threading manner with the thread portion of the cylindrical bolt 3*a* such that the female-threaded adjusting cylinder 9 is movable between the handle 3 and the stopper member 10. The female-threaded adjusting cylinder 9 is provided with an end surface 9*b* which faces toward the handle 3. Both diametrical ends of the pin 11 are engaged with the end surface 9*b*.

As explained hereinabove, the adjusting device 5 in the embodiment as shown in FIG. 6 is made up of the pin 11 which is movable inside the slit 2*c* which is longitudinally disposed in the shank 2 on the side of the handle 3, and the female-threaded adjusting cylinder 9 having an end surface 9*b* which faces toward the handle 3. Alternatively, the following arrangement may also be employed. Namely, a substantially L-shaped notched groove is provided in the handle portion of the umbrella so that a lever can be engaged with the notched groove.

Figure 9:
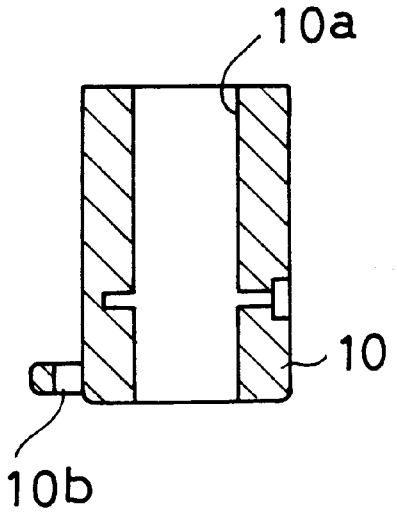
FIG. 9 is a sectional view of a stopper member.
Figure 10A:
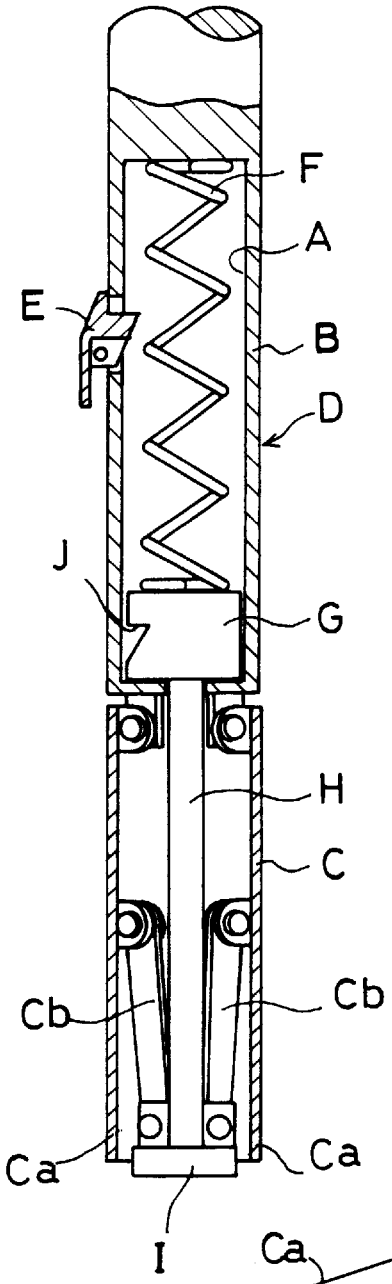
PRIOR ART FIG. 10 A
FIG. 10A is a sectional view of a ferrule portion of a conventional self-supporting umbrella in a state in which legs are closed.
Figure 10B:
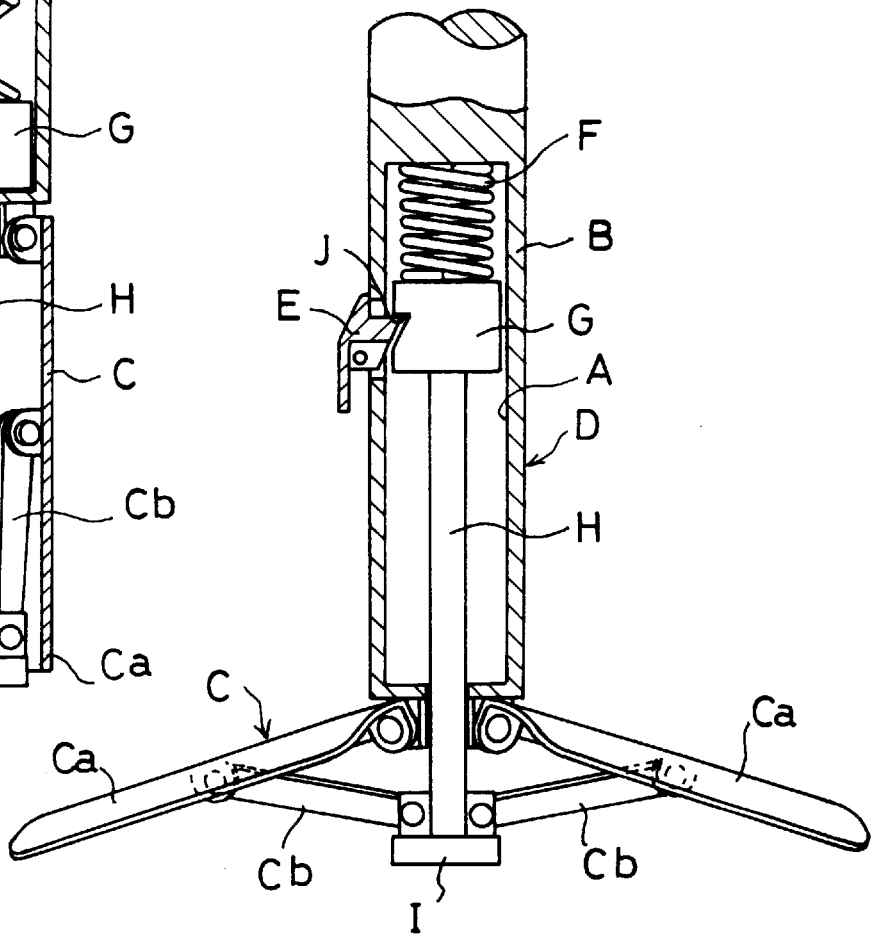
PRIOR ART FIG. 10 B
FIG. 10B is a sectional view of the ferrule portion of the conventional self-supporting umbrella in a state in which legs are opened.

The stopper member 10 is formed, as shown in FIG. 9, by a cylindrical member which has in its center a hole 10*a* for inserting therethrough the shank 2. A projection 10*b* is provided on that end of the stopper member 10 which lies on the side of the ferrule 4. A strap or a band with a suction member 12 attached to one end thereof is fixed to the projection 10*b*. The suction member 12 can thus be attached to a nearby wall or the like to temporarily support the umbrella.

As shown in FIG. 6, the shank 2 is provided with a cavity portion 2*d* for mounting therein a push button 14 for opening the umbrella. One end 15*a* of a plate spring 15 to which is attached the push button 14 is disposed in the cavity portion 2*d* such that the push button 14 projects outward from the cavity portion 2*d*. The plate spring 15 is latched on its opposite end with a slit 2*f* which is formed in the shank 2 on the side of the ferrule 4, and is provided with a lower hook 16 in an axially intermediate portion thereof. The lower hook 16 projects outward of the slit 2*e* of the shank 2. A lower ring (i.e., the one on the side of the handle 3) of the umbrella is engaged with this projection of the lower hook 16, whereby a state of closing the umbrella as shown in FIG. 1 is attained. When the push button 14 is pushed, the lower hook 16 which projects outward of the shank 2 is pushed inwards of the shank 2, whereby the engaging of the lower ring is released to open the umbrella.

When the female-threaded adjusting cylinder 9 is moved in its position from the position as shown in FIG. 1, i.e., the position in which the umbrella is closed, to a position in which the umbrella is opened, i.e., downwards as seen in FIG. 1 by rotating the female-threaded adjusting cylinder 9, the leg opening member 7 moves toward the legs 4*a* of the ferrule 4 as shown in FIG. 2. The projections 4*c* which are provided on the inner side of the pivoting portion 4*b* of the legs 4*a* are rotated or swung, whereby the legs 4*a* to partly constitute the ferrule 4 are opened.

When the female-threaded adjusting cylinder 9 is rotated to return it to the original position, the end surface 9*b*, which faces the handle 3, of the female-threaded adjusting cylinder 9 moves upward as a result of the movement of the female-threaded adjusting cylinder 9. The pin 11 which has been engaged therewith is moved toward the side of the handle 3. The leg opening member 7 which is connected to the pin 11 also moves toward the handle 3. The projections 4*c* which are pinched by the leg opening member 7 are rotated or swung in the direction opposite to that at the time of opening the legs 4*a*. As a result, the legs 4*a* in the ferrule 4 are closed.

As a modified embodiment of the above-described embodiment, the following arrangement may also be employed. Namely, the female-threaded adjusting cylinder 9, which is a part of the adjusting device 5, is mounted in a manner movable in the axial direction relative to the cylindrical bolt portion 3*a* of the handle 3. The female thread 9*a* of the female-threaded adjusting cylinder 9 is engaged with the threaded portion of the cylindrical bolt portion 3*a* near the terminal end of the leg closing stroke.

When the female-threaded adjusting cylinder 9 is pulled toward the handle 3, the pin 11 which is engaged with the end surface 9*b*, which faces the handle 3, of the female-threaded adjusting cylinder 9 moves toward the handle 3 as a result of the movement of the female-threaded adjusting cylinder 9. The leg operating member 7 which is connected to the pin 11 also moves toward the handle 3, whereby the legs 4*a* are closed. When the female-threaded adjusting cylinder 9 and the threaded portion of the cylindrical bolt 3*a* are brought into engagement with each other near the terminal end of the leg closing stroke, the state in which the legs are closed can be maintained. If the female-threaded adjusting cylinder 9 is rotated in the opposite direction to open the legs, the engagement is released, whereby the leg operating member 7 moves toward the front end direction of the umbrella due to the resilient force of the resilient member 7*c* to thereby open the legs 4*a*. By employing the above-described construction, while the adjustment of the opening degree of the legs 4*a* cannot be made, the legs 4*a* can easily and surely be opened and closed by slightly rotating the female-threaded adjusting cylinder 9.

As still another modified embodiment, the following arrangement may also be employed. Namely, instead of the female thread 9*a* of the female-threaded adjusting cylinder 9, a spiral groove is provided on an internal circumference of the female-threaded adjusting cylinder 9. Instead of the cylindrical bolt 3*a* of the handle 3, a projection is provided. In this manner, the projection is engaged with the spiral groove.

When the female-threaded adjusting cylinder 9 is rotated to open the legs, the female-threaded adjusting cylinder 9 moves toward the front end of the umbrella while the projection and the spiral groove remain engaged with each other. Due to the resilient force of the resilient member 7*c*, the leg operating member 7 moves toward the front end of the umbrella, whereby the legs 4*a* are opened. When the female-threaded adjusting cylinder 9 is rotated or swung in the opposite direction, the female-threaded adjusting cylinder 9 is moved toward the handle 3 while the projection and the spiral groove remain engaged with each other. The pin 11 which is engaged with the end surface 9*b*, which faces the handle side of the female-threaded adjusting cylinder 9, moves toward the handle 3 as a result of the movement of the female-threaded adjusting cylinder 9. The leg operating member 7 also moves toward the handle 3, whereby the legs 4*a* are closed. Also in this case, though the opening degree of the legs 4*a* cannot be adjusted, the legs 4*a* can be easily and surely be opened and closed by simply rotating the female-threaded adjusting cylinder 9.

As can be seen from the above-described explanations, in the self-supporting umbrella of the present invention, a projection which extends inward is formed inside a base end of each of the legs such that the projection can be rotated or swung to thereby swing each of the legs open. Therefore, the number of constituting parts is small and the connecting portions to connect each of the constituting parts are consequently small in number. The construction thus becomes simple and the assembly thereof is easy.

According to another aspect of the present invention, the legs can be opened or closed only by rotating the female-threaded adjusting cylinder at the handle of the umbrella. Therefore, it is not necessary for the operator or bearer of the umbrella to touch that front end of the umbrella which is ordinarily stained with mud or the like. In addition, the opening degree of the legs can be freely adjusted.

According to still another aspect of the present invention, when the legs are to be closed, the female-threaded adjusting cylinder is pulled toward the handle of the umbrella. Near the end of the closing stroke to close the legs, the female-threaded adjusting cylinder is brought into engagement with the cylindrical bolt portion to thereby maintain the legs in the closed state. When the legs are to be opened, the engagement between the female-threaded adjusting cylinder and the cylindrical bolt portion can be released simply by slightly rotating the female-threaded adjusting cylinder. Therefore, the opening or closing operation of the legs is made easily.

It is readily apparent that the above-described self-supporting umbrella meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A self-supporting umbrella having a handle at a base end portion of a shank and a ferrule at a front end portion of said shank, said ferrule provided with a plurality of legs manipulatable between being opened and closed, comprising:

a connecting member having a handle end and a leg end, the connecting member extends along a longitudinal axis of the umbrella;

a projection formed inside a base end of each of said legs extends inward toward said connecting member such that said base end of each of said legs is pivotally mounted on a ferrule base portion of said ferrule;

a resilient member fitted into the front end portion of said shank and substantially encompasses the leg end of the connecting member such that a leg operating member having a diametrically restricted section in an axially intermediate portion thereof is connected to a front end of said resilient member, a bottom face of said restricted section engages a top surface of said projection of each of said legs when said leg operating member is urged by a resilient force of said resilient member toward a front end of said umbrella; and an adjusting device provided in said handle, wherein the connecting member connects said adjusting device and said leg operating member such that said legs are manipulated between being opened and closed by moving said leg operating member by said adjusting device via said connecting member.

2. A self-supporting umbrella according to claim 1, wherein said adjusting device comprises:

a pin which is movable inside a slit longitudinally formed on that side of said shank which lies near said handle, said pin being tightly connected via said connecting member to said leg operating member;

a female-threaded adjusting cylinder which has an end surface looking toward said handle;

wherein both ends of said pin extend beyond said slit for engaging with said end surface of said adjusting cylinder and wherein said female-threaded adjusting cylinder is engaged with a cylindrical bolt portion which is provided in that end potion of said handle which lies near said shank such that said legs are opened and closed by moving said pin by the operation of said female-threaded adjusting cylinder.

3. A self-supporting umbrella according to claim 2, wherein said female-threaded adjusting cylinder is movable in an axial direction of said shank relative to said cylindrical bolt portion such that a female thread of said female-threaded adjusting cylinder comes into engagement with the threaded portion of said cylindrical bolt portion near an end of a stroke of closing said legs.

* * * * *